US006834767B1

(12) United States Patent
Lin

(10) Patent No.: US 6,834,767 B1
(45) Date of Patent: Dec. 28, 2004

(54) ANTI-THEFT SUSPENSION RACK ASSEMBLY

(76) Inventor: Chorng-Jiang Lin, No. 1, Lane 28, Dajhou St., Taichung City 407 (TW)

( * ) Notice: Subject to any disclaimer, the term of this patent is extended or adjusted under 35 U.S.C. 154(b) by 0 days.

(21) Appl. No.: 10/627,701

(22) Filed: Jul. 28, 2003

(51) Int. Cl.[7] ..... A47F 7/00
(52) U.S. Cl. ..... 211/70.6; 206/349; 206/372
(58) Field of Search ..... 211/70.6; 206/349, 206/372, 373, 376, 477, 478, 493; 224/904

(56) References Cited

U.S. PATENT DOCUMENTS 3,516,585 A * 6/1970 Inwood ..... 224/584
3,735,860 A * 5/1973 Nissen et al. ..... 206/349
4,069,915 A * 1/1978 Schurman ..... 206/305
4,586,615 A * 5/1986 Quitmann ..... 211/70.6
4,592,467 A * 6/1986 Lechner ..... 206/349
D327,801 S * 7/1992 Lee ..... D6/553
6,241,208 B1 * 6/2001 Lin ..... 248/309.1
6,637,591 B2 * 10/2003 Chen ..... 206/349
6,651,855 B1 * 11/2003 Flynn ..... 224/251
2003/0034316 A1 * 2/2003 Kao ..... 211/70.6

* cited by examiner

*Primary Examiner*—Robert W. Gibson, Jr.
(74) *Attorney, Agent, or Firm*—Rosenberg, Klein & Lee

(57) ABSTRACT

A suspension rack assembly includes a main body, an anti-theft lock, an upper secondary body, and a lower secondary body. Thus, the suspension rack assembly can be used to suspend a single tool or multiple sets of tools. In addition, the suspension rack assembly can be carried on the user's waist. Further, the hand tool is fixed on the anti-theft lock and the support rack of the main body rigidly and stably, thereby providing an anti-theft function.

19 Claims, 9 Drawing Sheets

ANTI-THEFT SUSPENSION RACK ASSEMBLY

BACKGROUND OF THE INVENTION

1. Field of the Invention

The present invention relates to a suspension rack assembly, and more particularly to a multifunctional anti-theft suspension rack assembly.

2. Description of the Related Art

A conventional suspension rack can be used to package and hang an article, such as a hand tool or the like, on the wall or the display shelf for exhibition use. However, after the hand tool is removed from the suspension rack, the suspension rack is broken and useless, and has to be thrown away, thereby causing consumption of material. In addition, it is necessary to prepare a tool box to store the hand tool when not in use. Further, the conventional suspension rack does not have an anti-theft function, so that the hand tool is easily stolen.

SUMMARY OF THE INVENTION

The primary objective of the present invention is to provide a suspension rack assembly having a package exhibition function.

Another objective of the present invention is to provide a suspension rack assembly having an anti-theft function.

A further objective of the present invention is to provide a suspension rack assembly that can be used to suspend a single tool or multiple sets of tools.

A further objective of the present invention is to provide a suspension rack assembly that can be carried on the user's waist.

A further objective of the present invention is to provide a suspension rack assembly, wherein the hand tool is fixed on the anti-theft lock and the support rack of the main body rigidly and stably, thereby providing an anti-theft function.

A further objective of the present invention is to provide a suspension rack assembly, wherein the anti-theft lock is integrally formed on the main body without needing an additional working process, thereby decreasing costs of fabrication.

A further objective of the present invention is to provide a suspension rack assembly, wherein the main body can co-operate with the anti-theft lock, the upper secondary body and the lower secondary body to provide different functions, thereby enhancing the versatility of the suspension rack assembly so as to satisfying the user's different requirements.

In accordance with the present invention, there is provided a suspension rack assembly, comprising:

- a main body having a lower portion provided with a protruding support rack and an upper portion provided with a protruding press portion; and
- an anti-theft lock integrally formed on the main body and located adjacent to the support rack of the main body;
- the anti-theft lock including a seat portion, and two arms each extended outward from the seat portion and each having a distal end formed with a retaining portion extended toward the support rack of the main body.

Further benefits and advantages of the present invention will become apparent after a careful reading of the detailed description with appropriate reference to the accompanying drawings.

DETAILED DESCRIPTION OF THE INVENTION

Figure 1:
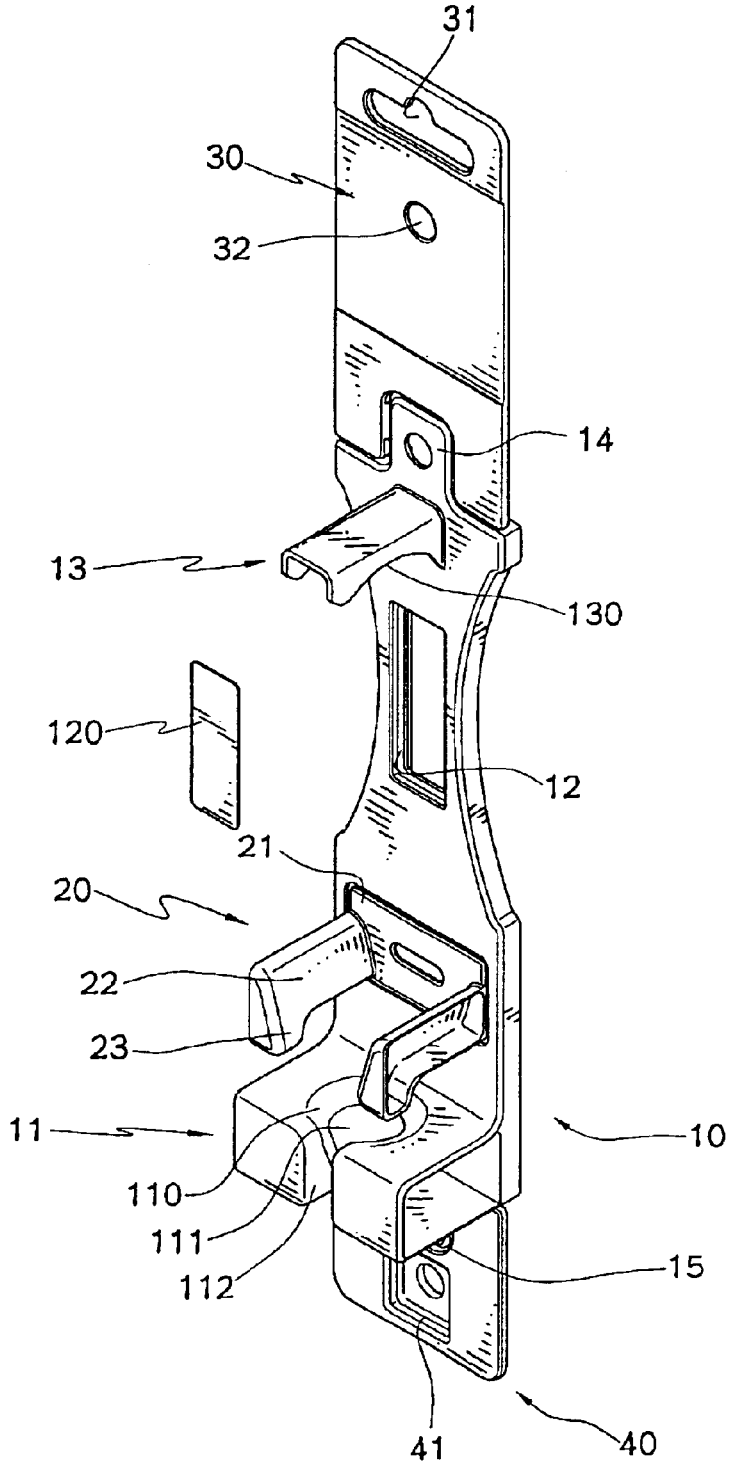
FIG. 1 is an exploded perspective view of a suspension rack assembly in accordance with the preferred embodiment of the present invention.
Figure 2:
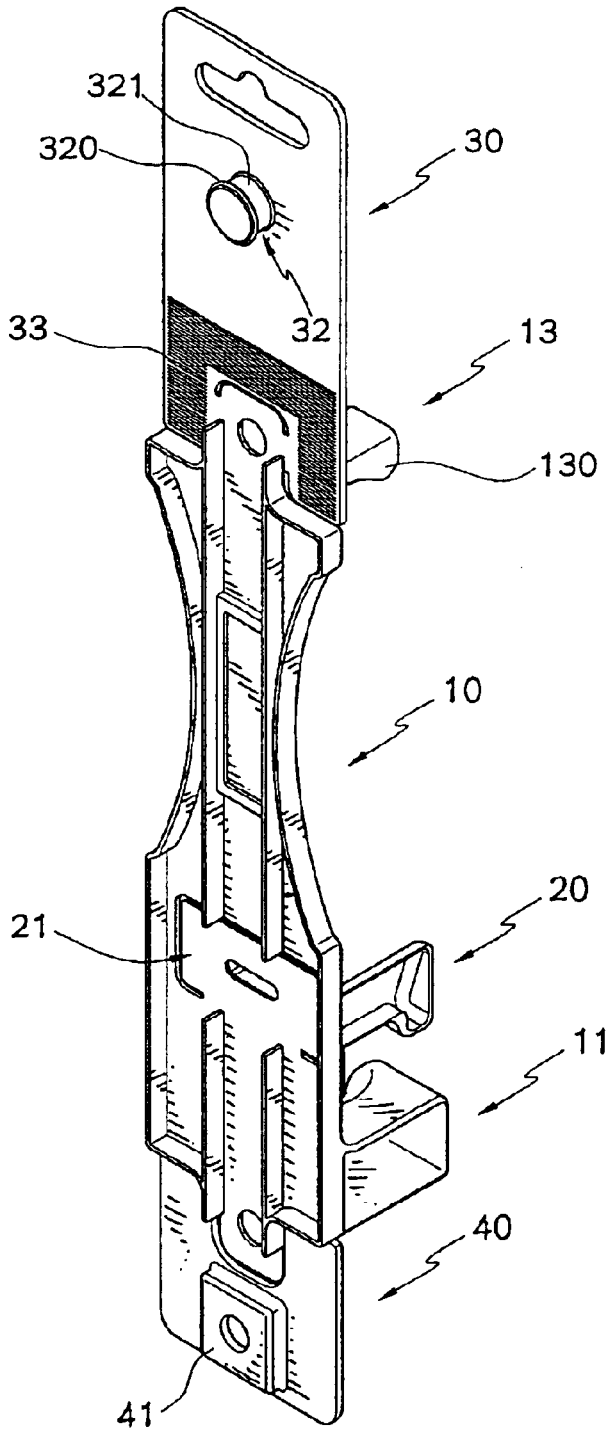
FIG. 2 is a perspective assembly view of the suspension rack assembly in accordance with the preferred embodiment of the present invention.

Referring to the drawings and initially to FIGS. 1–4, a suspension rack assembly in accordance with the preferred embodiment of the present invention comprises a main body 10, an anti-theft lock 20, an upper secondary body 30, and a lower secondary body 40.

The main body 10 has a lower portion provided with a protruding support rack 11 and an upper portion provided with a protruding press portion 13. The press portion 13 of the main body 10 has a bottom formed with a semi-circular guide portion 130. The main body 10 has a mediate portion formed with a receiving portion 12 for receiving an anti-theft label 120. The main body 10 has a top provided with a first fixing portion 14 and a bottom provided with a second fixing portion 15. The support rack 111 of the main body 10 has a central portion formed with a positioning hole 111 having a top formed with an enlarged opening 110. In addition, the support rack 11 of the main body 10 has a distal end formed with a passage 112 communicating with the positioning hole 111.

Figure 3:
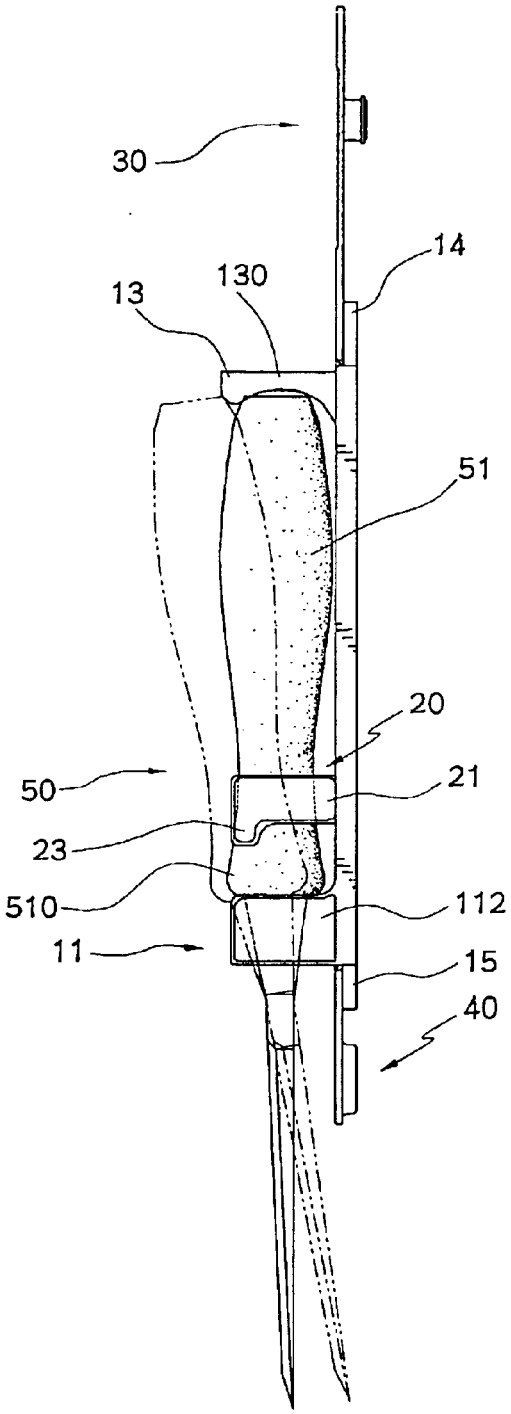
FIG. 3 is a side plan operational view of the suspension rack assembly as shown in FIG. 1.
Figure 3A:
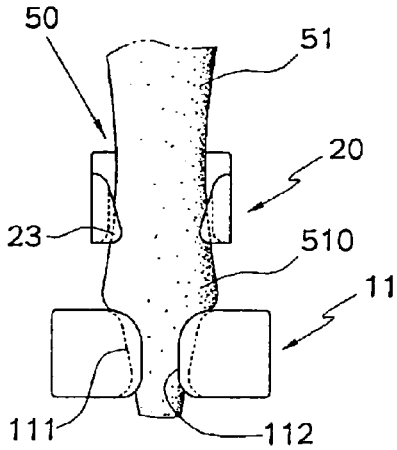
FIG. 3A is a partially cut-away front plan view of the suspension rack assembly as shown in FIG. 3.

As shown in FIGS. 3 and 3A, a hand tool 50, such as a screwdriver, is mounted on the main body 10. The hand tool 50 has a handle 51 retained by the support rack 11 of the main body 10. The handle 51 of the hand tool 50 has a top secured in the guide portion 130 of the press portion 13 of the main body 10.

The anti-theft lock 20 is integrally formed on the main body 10 and located above the support rack 11 of the main body 10. The anti-theft lock 20 includes a plate-shaped seat portion 21 having a periphery locally connected to the main body 10, and two arms 22 each extended outward from the seat portion 21. Each of the two arms 22 of the anti-theft lock 20 has a distal end formed with a triangular retaining portion 23 protruded outward and extended toward the support rack 11 of the main body 10 to retain the handle 51 of the hand tool 50 as shown in FIGS. 3 and 3A.

The upper secondary body 30 is mounted on the main body 10 and has a lower portion mounted on the first fixing portion 14 of the main body 10 and an upper portion formed with a slot-shaped hanging portion 31. The upper secondary body 30 is provided with a positioning portion 32 protruding outward therefrom. The positioning portion 32 of the upper secondary body 30 has a first end formed with a retaining neck 321 (see FIG. 2) and a second end formed with an enlarged mushroom-shaped guide head 320 having a dimension greater than that of the retaining neck 321. The upper secondary body 30 has a side provided with a locking tooth 33 (see FIG. 2).

The lower secondary body 40 is mounted on the main body 10 and has an upper portion mounted on the second fixing portion 15 of the main body 10. The lower secondary body 40 is provided with a fixing portion 41 protruding outward therefrom.

As shown in FIGS. 3 and 3A, when the hand tool 50 is mounted on the main body 10, the cone-shaped bottom portion 510 of the handle 51 of the hand tool 50 is clamped between the retaining portions 23 of the anti-theft lock 20 and the positioning hole 111 of the support rack 11 of the main body 10, while the top portion of the handle 51 of the hand tool 50 is secured in the guide portion 130 of the press portion 13 of the main body 10, so that the hand tool 50 is fixed on the anti-theft lock 20 and the support rack 11 of the main body 10 rigidly and stably, thereby providing an anti-theft function.

Figure 4:
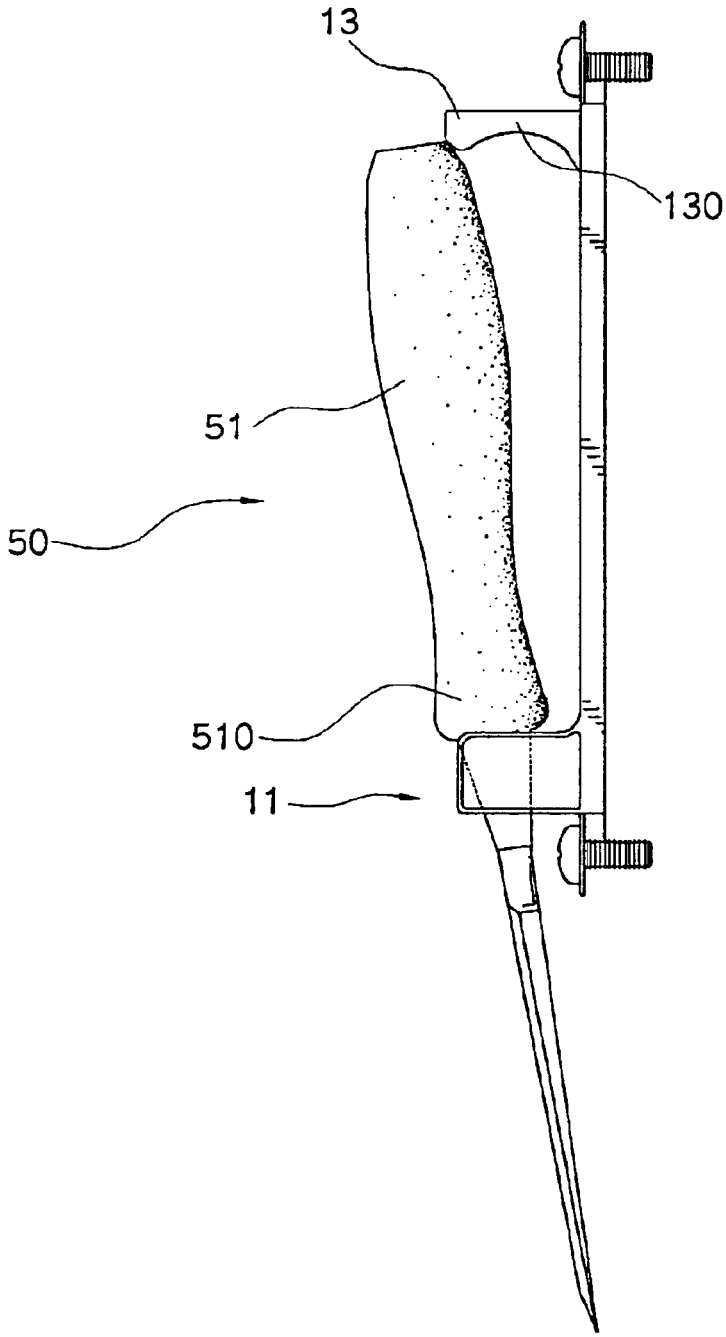
FIG. 4 is a side plan operational view of the suspension rack assembly as shown in FIG. 1.

As shown in FIG. 4, after the consumer purchases the hand tool 50, the connection between the seat portion 21 of the anti-theft lock 20 and the main body 10 is broken to detach the seat portion 21 of the anti-theft lock 20 from the main body 10, so that the hand tool 50 can be detached from the support rack 11 of the main body 10 easily and conveniently for use.

In addition, when not in use, the bottom portion 510 of the handle 51 of the hand tool 50 is retained by the positioning hole 111 of the support rack 11 of the main body 10, while the top portion of the handle 51 of the hand tool 50 is secured in the guide portion 130 of the press portion 13 of the main body 10, so that the hand tool 50 is supported on the support rack 11 of the main body 10 rigidly and stably. At this time, the first fixing portion 14 or the second fixing portion 15 of the main body 10 can be fixed on the wall or other object by a screw or the like, thereby fixing the main body 10 and the hand tool 50.

Figure 5:
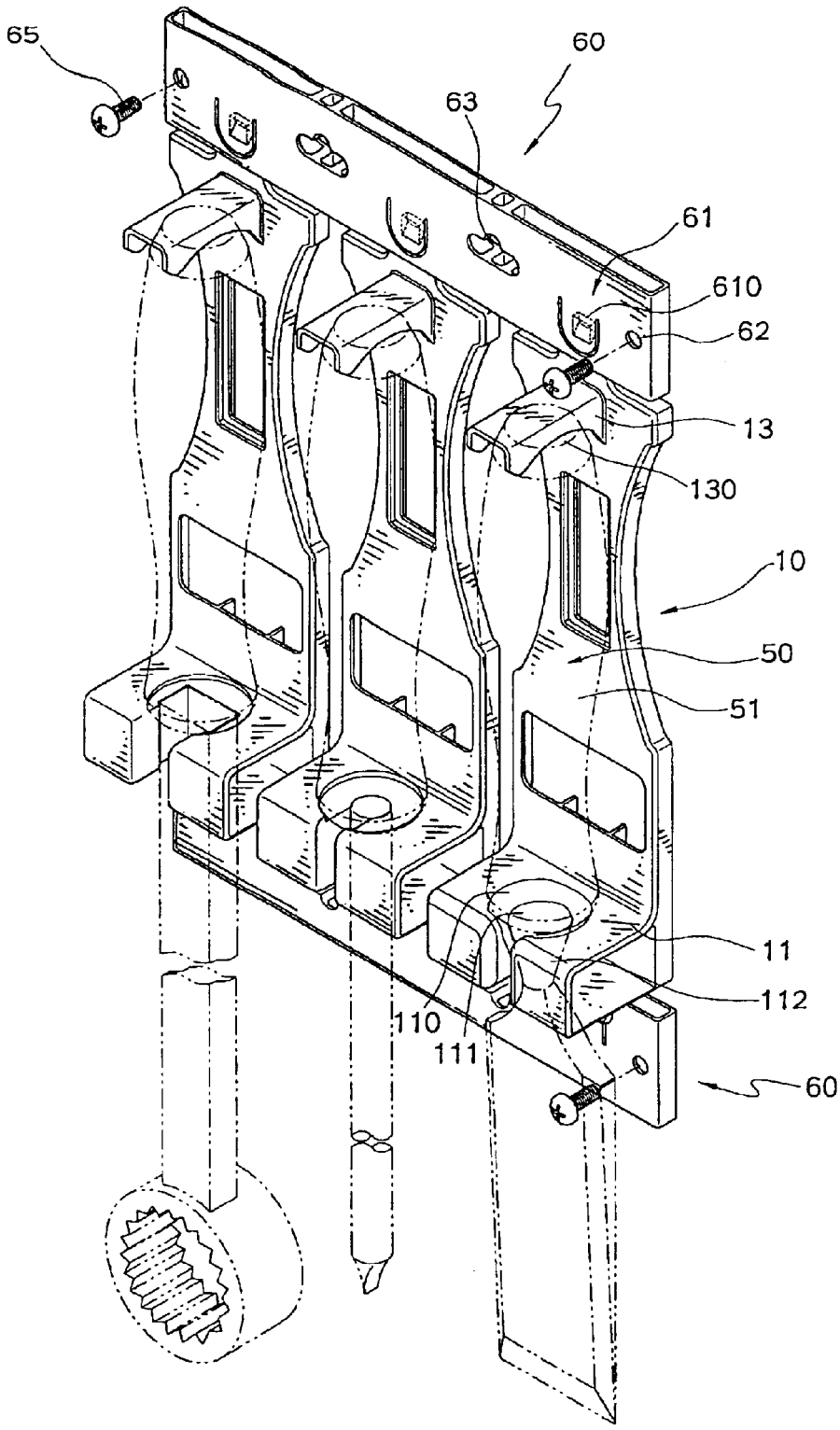
FIG. 5 is a perspective assembly view of the suspension rack assembly in accordance with another embodiment of the present invention.

As shown in FIG. 5, the suspension rack assembly further comprises a suspension rack 60 mounted on the main body 10 and includes at least one elastic locking members 61 provided with a locking portion 610 locked in the first fixing portion 14 or the second fixing portion 15 of the main body 10, so that first fixing portion 14 or the second fixing portion 15 of the main body 10 is attached to the suspension rack 60. The suspension rack 60 is formed with two fixing holes 62, so that the suspension rack 60 can be fixed on the wall or other object by screws 65. The suspension rack 60 is formed with two hanging portions 63, so that the suspension rack 60 can be suspended on the wall or other object.

Figure 6:
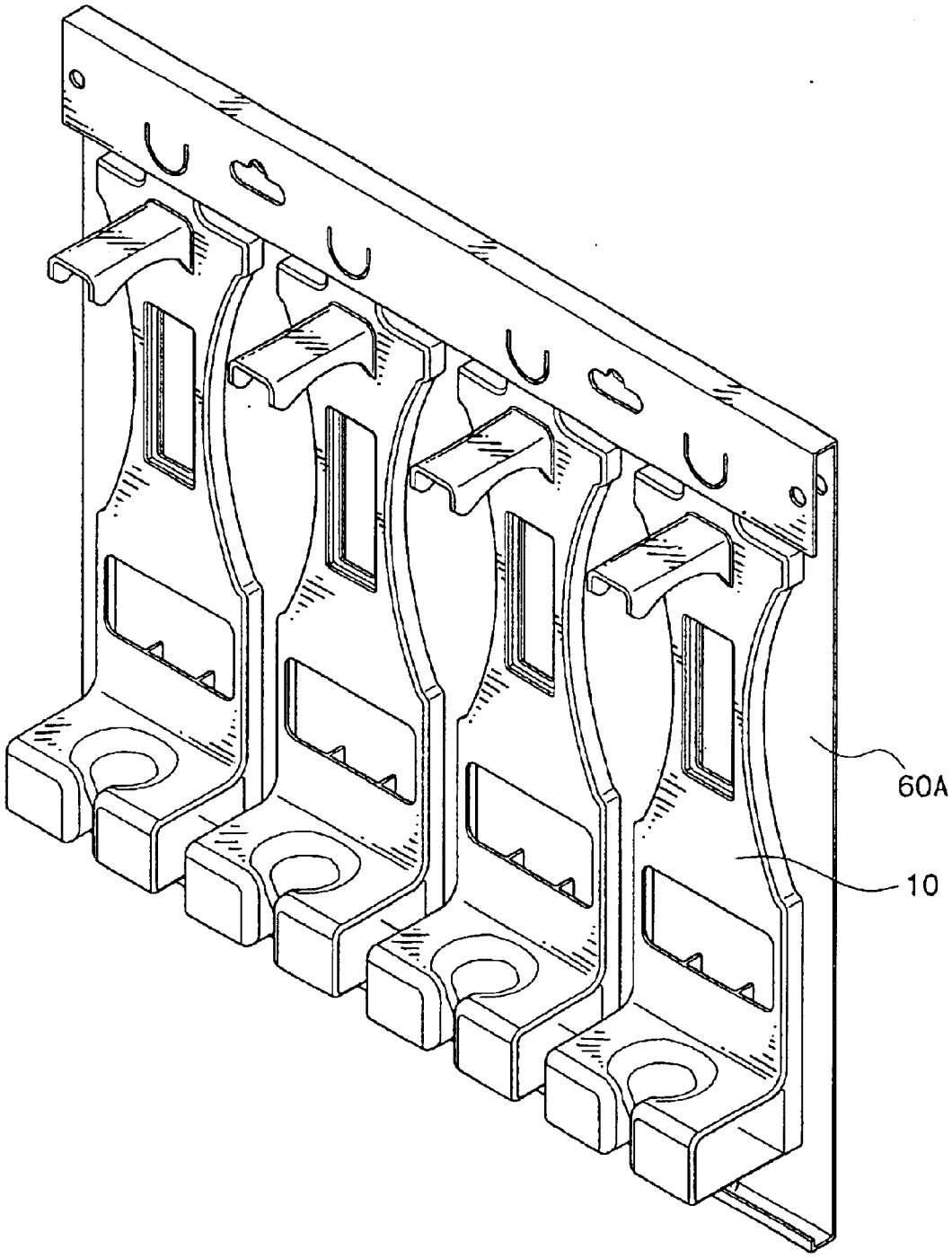
FIG. 6 is a perspective assembly view of the suspension rack assembly in accordance with another embodiment of the present invention.

As shown in FIG. 6, in accordance with another embodiment of the present invention, the suspension rack 60A has a different configuration.

Figure 7:
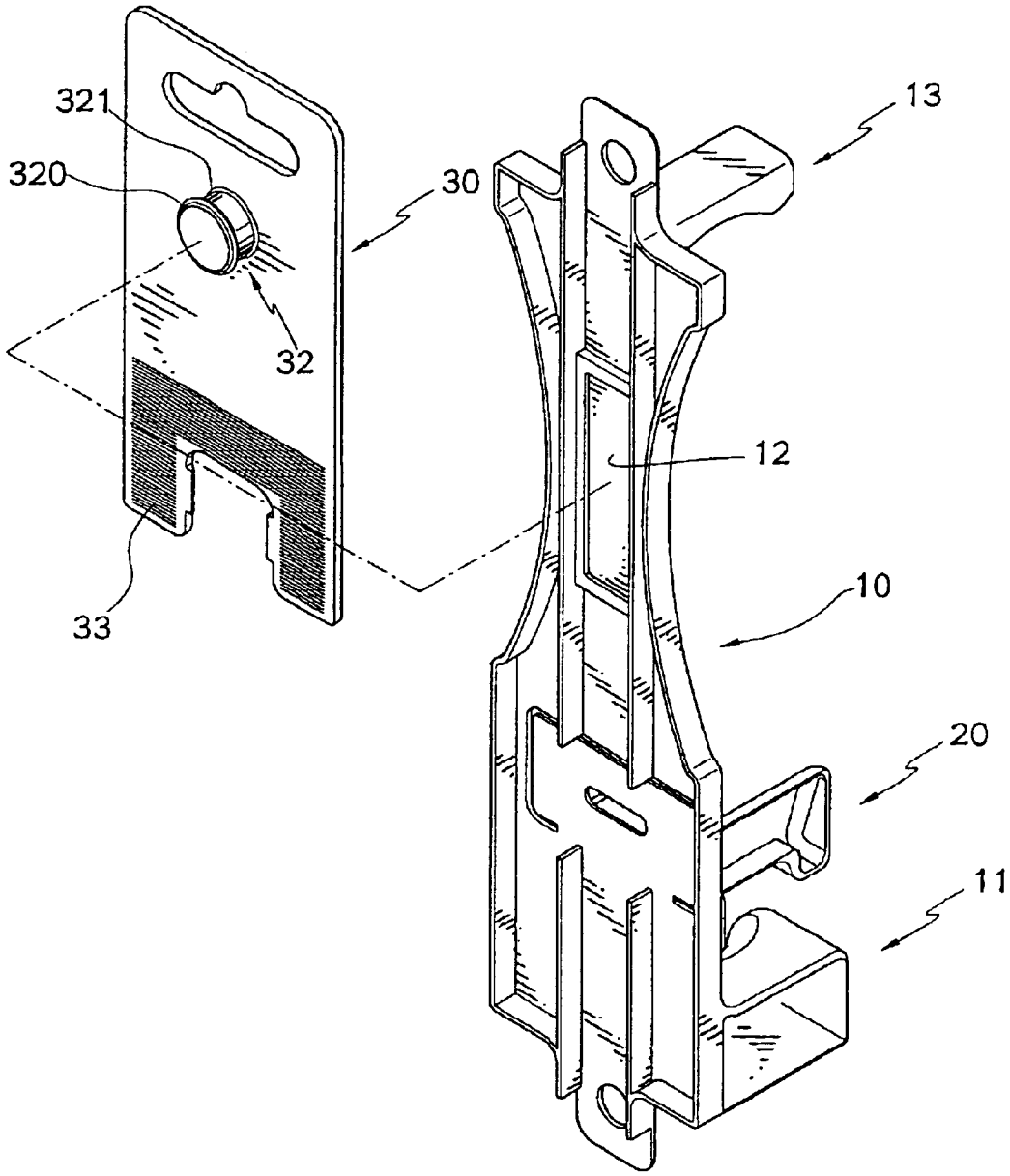
FIG. 7 is an exploded perspective view of the suspension rack assembly in accordance with the preferred embodiment of the present invention.
Figure 8:
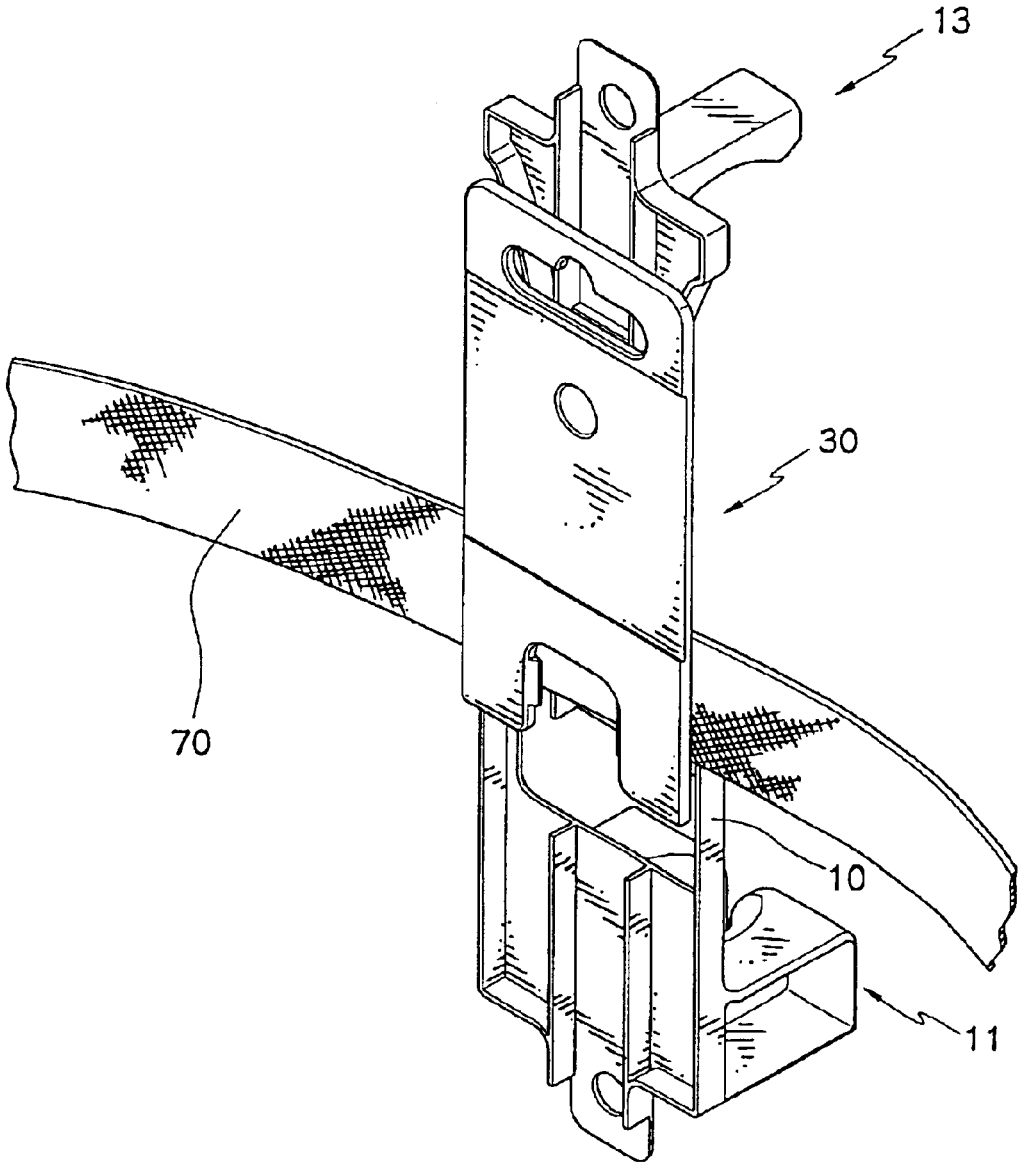
FIG. 8 is a perspective assembly view of the suspension rack assembly as shown in FIG. 7.
Figure 9:
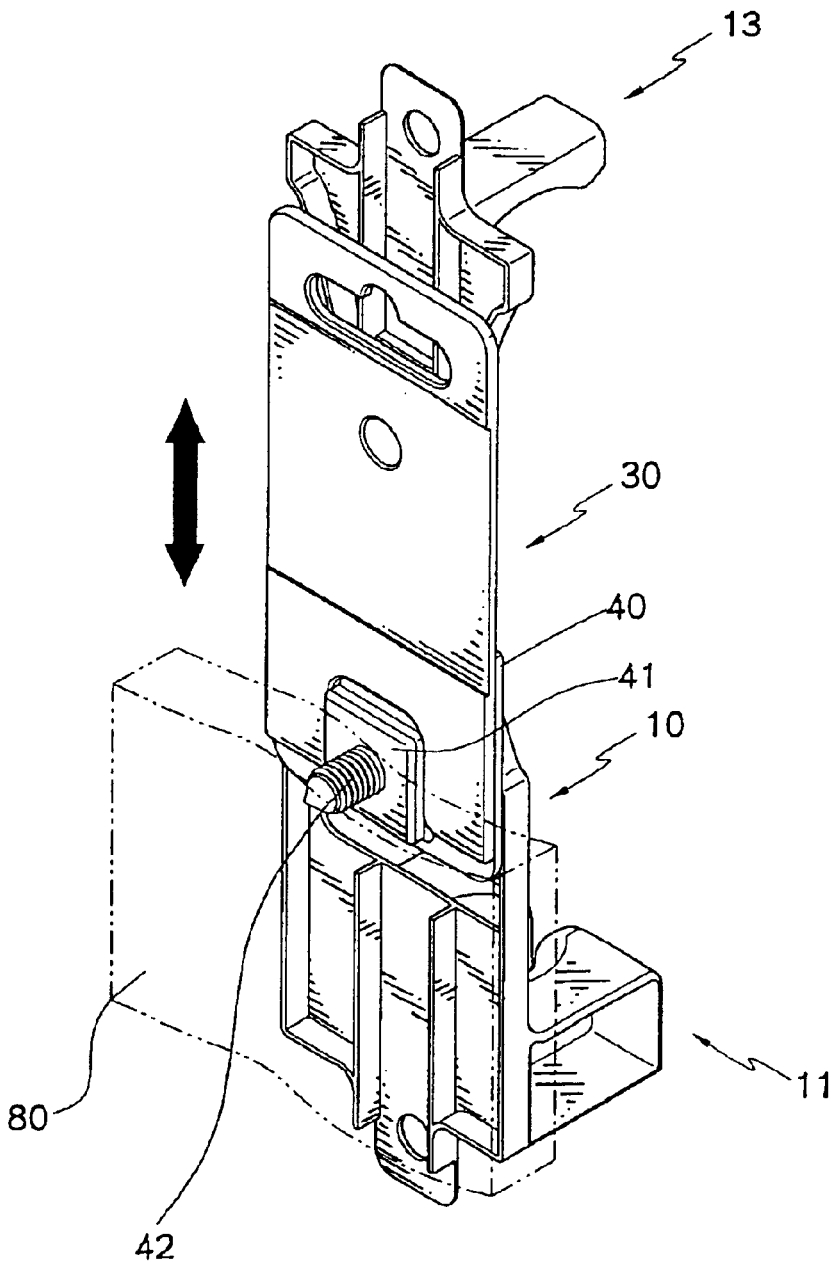
FIG. 9 is a schematic operational view of the suspension rack assembly as shown in FIG. 8.

Referring to FIGS. 7–9, the guide head 320 of the positioning portion 32 of the upper secondary body 30 is extended through the receiving portion 12 of the main body 10, and the retaining neck 321 of the positioning portion 32 of the upper secondary body 30 is slidably mounted in the receiving portion 12 of the main body 10, so that the upper secondary body 30 can be rotated relative to the main body 10 about the positioning portion 32.

In addition, a waist belt 70 is extended between the upper secondary body 30 and the main body 10, and is locked by the locking tooth 33 of the upper secondary body 30, so that the main body 10 is fixed on the waist belt 70, thereby facilitating the user carrying the hand tool 50 and the main body 10 on the waist belt 70.

Further, the fixing portion 41 of the lower secondary body 40 is fixed on the wall 80 by a screw member 42, and the bottom of the upper secondary body 30 is inserted into the gap between the lower secondary body 40 and the wall 80, so that the main body 10 and the upper secondary body 30 can be removed from the waist belt 70 and can be hung on the lower secondary body 40.

Accordingly, the bottom portion 510 of the handle 51 of the hand tool 50 is clamped between the retaining portions 23 of the anti-theft lock 20 and the positioning hole 111 of the support rack 11 of the main body 10, while the top portion of the handle 51 of the hand tool 50 is secured in the guide portion 130 of the press portion 13 of the main body 10, so that the hand tool 50 is fixed on the anti-theft lock 20 and the support rack 11 of the main body 10 rigidly and stably, thereby providing an anti-theft function.

In addition, the anti-theft lock 20 is integrally formed on the main body 10 without needing an additional working process, thereby decreasing costs of fabrication.

Further, the main body 10 can co-operate with the anti-theft lock 20, the upper secondary body 30 and the lower secondary body 40 to provide different functions, thereby enhancing the versatility of the suspension rack assembly so as to satisfying the user's different requirements.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A suspension rack assembly, comprising:

a main body having a lower portion provided with a protruding support rack and an upper portion provided with a protruding press portion; and an anti-theft lock integrally formed on the main body and located adjacent to the support rack of the main body;

the anti-theft lock including a seat portion, and two arms each extended outward from the seat portion and each having a distal end formed with a retaining portion extended toward the support rack of the main body.

2. The suspension rack assembly in accordance with claim 1, wherein the press portion of the main body has a bottom formed with a semi-circular guide portion.

3. The suspension rack assembly in accordance with claim 1, wherein the main body has a mediate portion formed with a receiving portion for receiving an anti-theft label.

4. The suspension rack assembly in accordance with claim 1, wherein the support rack of the main body has a central portion formed with a positioning hole having a top formed with an enlarged opening.

5. The suspension rack assembly in accordance with claim 4, wherein the support rack of the main body has a distal end formed with a passage communicating with the positioning hole.

6. The suspension rack assembly in accordance with claim 1, wherein the seat portion of the anti-theft lock has a periphery locally connected to the main body.

7. The suspension rack assembly in accordance with claim 1, further comprising an upper secondary body mounted on the main body.

8. The suspension rack assembly in accordance with claim 7, wherein the main body has a top provided with a first fixing portion, and the upper secondary body has a lower portion mounted on the first fixing portion of the main body.

9. The suspension rack assembly in accordance with claim 7, wherein the upper secondary body has an upper portion formed with a slot-shaped hanging portion.

10. The suspension rack assembly in accordance with claim 7, wherein the upper secondary body is provided with a positioning portion protruding outward therefrom, the positioning portion of the upper secondary body has a first end formed with a retaining neck and a second end formed with an enlarged guide head having a dimension greater than that of the retaining neck.

11. The suspension rack assembly in accordance with claim 7, wherein the upper secondary body has a side provided with a locking tooth.

12. The suspension rack assembly in accordance with claim 1, further comprising a lower secondary body mounted on the main body.

13. The suspension rack assembly in accordance with claim 12, wherein the main body has a bottom provided with a second fixing portion, and the lower secondary body has an upper portion mounted on the second fixing portion of the main body.

14. The suspension rack assembly in accordance with claim 12, wherein the lower secondary body is provided with a fixing portion protruding outward therefrom.

15. The suspension rack assembly in accordance with claim 1, wherein the main body has a top provided with a first fixing portion, and a bottom provided with a second fixing portion, and the suspension rack assembly further comprises a suspension rack mounted on the main body and including at least one elastic locking members provided with a locking portion locked in either one of the first fixing portion and the second fixing portion of the main body.

16. The suspension rack assembly in accordance with claim 15, wherein the suspension rack is formed with two fixing holes.

17. The suspension rack assembly in accordance with claim 15, wherein the suspension rack is formed with two hanging portions.

18. The suspension rack assembly in accordance with claim 10, wherein the guide head of the positioning portion of the upper secondary body is extended through the receiving portion of the main body, and the retaining neck of the positioning portion of the upper secondary body is slidably mounted in the receiving portion of the main body, so that the upper secondary body can be rotated relative to the main body about the positioning portion.

19. A suspension rack assembly, comprising:

a main body having a lower portion provided with a protruding support rack and an upper portion provided with a protruding press portion;

and an upper secondary body mounted on the main body, the main body has a top provided with a first fixing portion, and the upper secondary body has a lower portion mounted on the first fixing portion of the main body, a lower secondary body mounted on the main body, the main body has a bottom provided with a second fixing portion, and the lower secondary body has an upper portion mounted on the second fixing portion of the main body.

* * * * *